US008242358B2

(12) United States Patent
Park et al.

(10) Patent No.: US 8,242,358 B2
(45) Date of Patent: Aug. 14, 2012

(54) MICRO COAXIAL CABLE FOR HIGH BENDING PERFORMANCE

(75) Inventors: Chan-Yong Park, Geumcheon-gu (KR); Il-Gun Seo, Anyang-si (KR); Gi-Joon Nam, Seocho-gu (KR); Jung-Won Park, Seongnam-si (KR); In-Ha Kim, Seocho-gu (KR); Gun-Joo Lee, Gangnam-gu (KR); June-Sun Kim, Gwacheon-si (KR)

(73) Assignee: LS Cable & System Ltd., Anyang-si, Gyeonggi-do (KR)

( * ) Notice: Subject to any disclaimer, the term of this patent is extended or adjusted under 35 U.S.C. 154(b) by 441 days.

(21) Appl. No.: 12/526,023

(22) PCT Filed: Nov. 8, 2007

(86) PCT No.: PCT/KR2007/005625

§ 371 (c)(1),
(2), (4) Date: Aug. 13, 2009

(87) PCT Pub. No.: WO2008/096947

PCT Pub. Date: Aug. 14, 2008

(65) Prior Publication Data

US 2010/0314152 A1 Dec. 16, 2010

(30) Foreign Application Priority Data

Feb. 7, 2007 (KR) ..... 10-2007-0012733

(51) Int. Cl.
*H01B 7/00* (2006.01)

(52) U.S. Cl. ..... 174/28

(58) Field of Classification Search ..... 174/36, 174/126.1, 126.2, 128.1, 102 R, 106 R, 108; 148/433, 436, 432

See application file for complete search history.

(56) References Cited

U.S. PATENT DOCUMENTS

| | | | | |
|---|---|---|---|---|
| 4,358,636 | A * | 11/1982 | Ijff et al. | 174/103 |
| 4,638,114 | A * | 1/1987 | Mori | 174/36 |
| 4,970,112 | A * | 11/1990 | Hayami | 428/314.4 |
| 5,106,701 | A | 4/1992 | Kurosaka et al. | |
| 5,558,794 | A * | 9/1996 | Jansens | 219/549 |
| 6,477,767 | B1 * | 11/2002 | Zhao | 29/828 |
| 6,518,505 | B1 * | 2/2003 | Matsui et al. | 174/126.1 |
| 6,627,009 | B1 * | 9/2003 | Matsui et al. | 148/433 |
| 8,017,867 | B2 * | 9/2011 | Cho et al. | 174/110 R |
| 2002/0029896 | A1 * | 3/2002 | Yokoi et al. | 174/102 R |
| 2002/0146912 | A1 | 10/2002 | Miyajima et al. | |
| 2003/0051897 | A1 * | 3/2003 | Blouin et al. | 174/106 R |
| 2007/0068696 | A1 * | 3/2007 | Matsui et al. | 174/113 R |
| 2008/0047732 | A1 * | 2/2008 | Park et al. | 174/107 |

FOREIGN PATENT DOCUMENTS

| | | |
|---|---|---|
| EP | 0440184 | 8/1991 |
| JP | 60-243238 | * 12/1985 |
| JP | 2001-295011 | 10/2001 |
| JP | 2003-187649 | 7/2003 |
| JP | 2004-327345 | 11/2004 |

* cited by examiner

*Primary Examiner* — William Mayo, III
(74) *Attorney, Agent, or Firm* — Sherr & Vaughn, PLLC

(57) ABSTRACT

A micro coaxial cable with a high bending performance, having an inner conductor; an insulating layer configured to surround the inner conductor, and a helical winding conductor configured to surround the insulating layer and having an elongation of 1.5 to 4% and a pitch of 3.0 to 5.0 mm.

12 Claims, 2 Drawing Sheets

MICRO COAXIAL CABLE FOR HIGH BENDING PERFORMANCE

CROSS REFERENCE TO PRIOR APPLICATIONS

This application is a National Stage Patent Application of International Patent Application No. PCT/KR2007/005625 (filed on Nov. 8, 2007) under 35 U.S.C. 371, which claims priority to Korean Patent Application No. 10-2007-0012733 (filed on Feb. 7, 2007), which are both hereby incorporated by reference in their entirety.

TECHNICAL FIELD

The present invention relates to a coaxial cable, in particular, to a micro coaxial cable.

BACKGROUND ART

Generally, a coaxial cable is a transmission line comprising an inner conductor for signal transmission and a shield layer formed on a concentric axis of the inner conductor, when the coaxial cable is viewed in cross section, the inner conductor and the shield layer form concentric circles, and an insulating layer having a dieletric property is formed between the inner conductor and the shield layer.

The coaxial cable has been developed as various products according to size and kind, and due to structural characteristics, the coaxial cable has a small change in attenuation or transmission delay of a signal according to frequency and can transmit simultaneously a large capacity data. And, even when a plurality of coaxial cables are received in a single cable, signal leakage between the coaxial cables is insignificant.

FIG. 1 is a view illustrating a structure of a conventional coaxial cable, and as shown in FIG. 1, the conventional coaxial cable comprises an inner conductor 11, an outer conductor (metal shield layer) 17, a polymer insulating layer (dielectric layer) 13 formed between the inner conductor 11 and the outer conductor 17, and a protective coating layer 19 formed along the outer periphery of the outer conductor 17.

The development trend of the conventional coaxial cable moved toward improvement of a structure between the inner conductor and the outer conductor for reducing the loss of transmission energy or improvement of dielectric characteristics for enhancing the transmission speed. In particular, with the recent development of an advanced information-oriented society, there is an increasing demand for high speed transmission of a device for testing/inspecting an information communication equipment and a semiconductor device used in such an equipment.

Meanwhile, as a mobile phone or a ultrathin equipment of high definition gets smaller in size, a micro coaxial cable having a diameter of 1 □ or less is developed lively to drive the small-sized equipment. Like the conventional coaxial cable, the micro coaxial cable comprises basically an inner conductor, an insulating layer, an outer conductor and a protective coating layer. However, the micro coaxial cable is received in a small-sized equipment, and thus should provide a long-term uniform reliability in a severe environment such as rotation or bending. Recently, a mobile phone or a ultrathin equipment of high definition is manufactured in the form of bending and/or rotation, and accordingly, the micro coaxial cable received in such an equipment should provide a long-term uniform reliability in a severe environment such as bending or rotation.

However, as mentioned above, the conventional coaxial cable has been developed to enhance transmission speed or reduce the loss of transmission energy, but did not show any development progress for providing a long-term uniform reliability in a severe environment such as bending or rotation.

DISCLOSURE OF INVENTION

Technical Problem

The present invention was suggested to solve the above-mentioned problem, and an object of the present invention is to provide a micro coaxial cable with a high bending performance for providing a long-term uniform reliability in a severe environment such as bending or rotation.

The other features, advantages and benefits of the present invention will be understood by the following description, and be explained more clearly through embodiments of the present invention. And, it should be known that the features, advantages and benefits of the present invention will be realized by configurations recited in the claims and combinations thereof.

Technical Solution

In order to achieve the above-mentioned object, a micro coaxial cable with a high bending performance comprises an inner conductor; an insulating layer configured to surround the inner conductor; and a non-annealed helical winding conductor configured to surround the insulating layer and having an elongation of 1.5 to 4%.

Preferably, the helical winding conductor has a pitch of 3.0 to 5.0 □.

Also, the micro coaxial cable of the present invention may further comprise a protective coating layer configured to surround the helical winding conductor.

And, preferably, the helical winding conductor may contain tin of 0.3 to 0.6% or silver of 0.6 to 2.0%.

Also, preferably, the helical winding conductor includes a plurality of metal lines wound in the form of a helical twist.

Further, the inner conductor includes a plurality of twisted metal lines.

And, the micro coaxial cable of the present invention may further comprise an over-foaming barrier layer formed between the insulating layer and the helical winding conductor and configured to prevent over-foaming of the insulating layer, so that foam cells are formed uniformly in the insulating layer.

BEST MODE FOR CARRYING OUT THE INVENTION

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention. Hereinafter, a preferred embodiment of the present invention will be described in detail with reference to the accompanying drawings.

Figure 1:
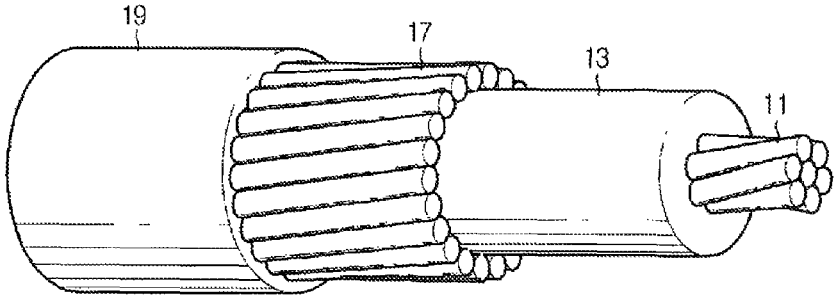
FIG. 1 is a view illustrating a structure of a conventional coaxial cable.
Figure 2:
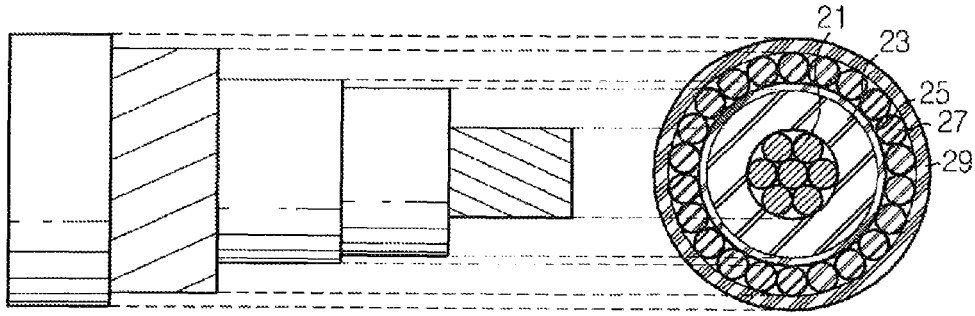
FIG. 2 is a view illustrating a structure of a micro coaxial cable with a high bending performance according to an embodiment of the present invention.

FIG. 2 is a view illustrating a structure of a micro coaxial cable with a high bending performance according to an embodiment of the present invention.

Referring to FIG. 2, the micro coaxial cable according to an embodiment of the present invention comprises an inner conductor 21, an insulating layer 23 configured to surround the inner conductor 21, an over-foaming barrier layer 25 configured to be contacted with and surround the insulating layer 23, a helical winding conductor 27 configured to be contacted with and surround the over-foaming barrier layer 25, and a protective coating layer 29 configured to surround the helical winding conductor 27.

The inner conductor 21 may include at least one electric line, and preferably the inner conductor 21 is configured as a strand having a predetermined pitch by twisting the at least one electric line. In consideration of electrical conductivity and economic efficiency, preferably the electric line is made of a copper alloy. In consideration of the diameter of the micro coaxial cable, preferably the inner conductor 21 has a diameter of 0.04 to 0.09 □, and in the case that the inner conductor 21 includes a plurality of twisted electric lines, preferably each electric line has a diameter 0.01 to 0.04 □.

The insulating layer 23 is formed along the outer periphery of the inner conductor 21, and is made by extruding and coating a polymer having a low dielectricity to improve transmission characteristics. To make low dielectricity, it is preferable to use a fluoride-based polymer, more preferably PFA (perfluoroalkyl). And, to further make low dielectricity, the polymer may be foamed to form foam cells in the insulating layer 23. For this purpose, a gas injection device, a mixing screw and a nozzle are installed in an extruding machine, and the foam cells are through an outlet of the extruding machine.

The over-foaming barrier layer 25 is configured to be in contact with the insulating layer 23 and surround the insulating layer 23. When the foam cells are formed in the insulating layer 23, the over-foaming barrier layer 25 suppresses over-foaming to form uniformly the foam cells in the insulating layer 23, prevent formation of an abnormal foam cell and allow for the foam cells to adjoin each other.

The helical winding conductor 27 is configured to be wound (spirally) in the form of a helical twist along the outer periphery of the over-foaming barrier layer 25 to provide a high reliability against repetitive bending. The inventors of the present invention found that mechanical characteristics of the micro coaxial cable are significantly influenced by characteristics of the helical winding conductor 27 as well as the inner conductor 21 and the insulating layer 23. Conventionally, an annealed copper wire of a high elongation (7 to 9%) was used as the helical winding conductor 27, which is easy to maintain its shape when it is connected to a connector, however the present invention verifies that annealing, elongation and pitch of the helical winding conductor 27 are important as main factors for influencing the mechanical reliability of the helical winding conductor 27, and uses a non-annealed hand-drawn copper wire having an elongation of 1.5 to 4% and a pitch of 3.0 to 5.0 □ as the helical winding conductor 27. At this time, preferably the non-annealed helical winding conductor 27 of the present invention contains tin of 0.3 to 0.6% and/or silver of 0.6 to 2.0%. The use of tin or silver with the above-mentioned content satisfies elongation and electrical characteristics as well as economical requirements.

Meanwhile, the protective coating layer 29 is formed along the outer periphery of the helical winding conductor 27 to protect the micro coaxial cable. The protective coating layer 29 may be made of all materials for a protective coating layer of the conventional coaxial cable without limitation.

Hereinafter, the non-annealed helical winding conductor 27 of the present invention is described through a bending performance test according to elongation and pitch.

In the case that an annealed copper wire was used as the helical winding cable 27 according to the prior art, when a load of 200 gram force was applied to a micro coaxial cable of 40 core, a breakage phenomenon occurred at about one hundred twenty thousand times in a bending test of ±90°. However, in the case that a non-annealed copper wire was used as the helical winding cable 27 according to the present invention as follows, the helical winding cable 27 could ensure a bending reliability of at least one hundred fifty thousand times on the same conditions.

Figure 3:
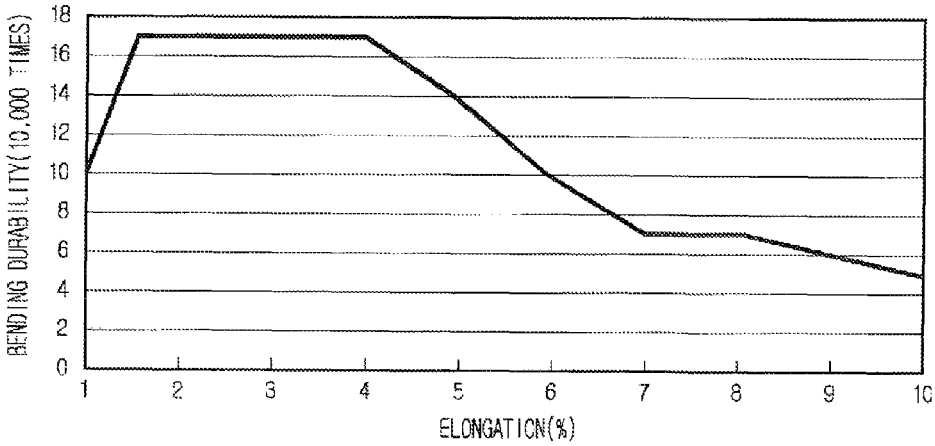
FIG. 3 is a graph illustrating a bending durability according to elongation of a helical winding conductor.

FIG. 3 is a graph illustrating a bending durability according to elongation of the helical winding conductor 27. As shown in FIG. 3, the bending durability of the helical winding conductor 27 was highest in the elongation range of 1.5 to 4%. The helical winding conductor 27 showed bending durability of about one hundred seventy thousand times in the elongation range of 1.5 to 4%. In the case of an elongation range of 1% or less, the helical winding conductor 27 showed low bending performance due to excessive stresses in a repetitive bending test, and in the case of an elongation range of 5% or more, the helical winding conductor 27 showed similar characteristics to an annealed copper wire and consequently low bending reliability.

Figure 4:
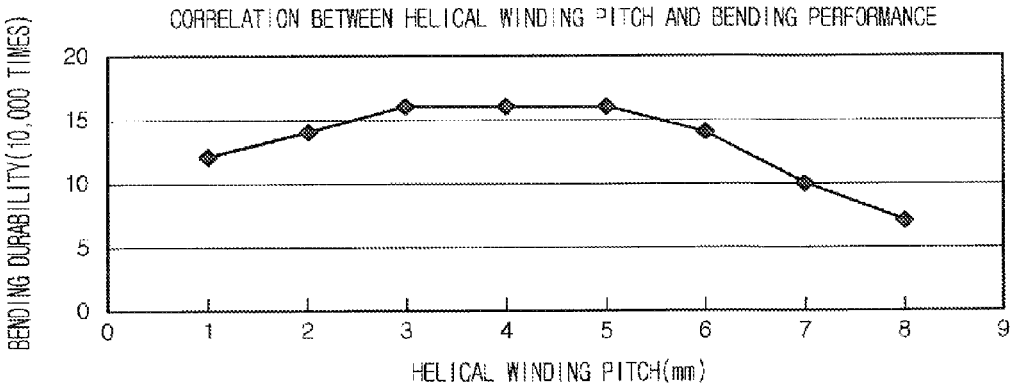
FIG. 4 is a graph illustrating a bending durability according to pitch of the helical winding conductor.

FIG. 4 is a graph illustrating a bending durability according to pitch of the helical winding conductor 27. As shown in FIG. 4, the bending durability of the helical winding conductor 27 was highest in the pitch range of 3.0 to 5.0 □. The helical winding conductor 27 showed bending durability of about one hundred sixty thousand times in the pitch range of 3.0 to 5.0 □. In the case of a pitch range of 3.0 □ or less, the helical winding conductor 27 showed low bending performance due to excessive stresses, and in the case of a pitch range of 5.0 □, the helical winding conductor 27 had an insufficient force for holding repetitive bending and consequently low bending reliability.

The helical winding conductor 27 with a high bending performance according to the present invention can be applied to micro coaxial cables of 40, 42 and 44 AWG (American Wire Gauge) standards.

As such, the preferred embodiments of the present invention were described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

The micro coaxial cable according to the present invention provides along-term mechanical reliability that was impossible in the prior art. For example, in the case that the micro coaxial cable is applied to a mobile phone, assuming that the mobile phone is opened and closed 50 times a day, the micro coaxial cable guarantees a stable quality for at least 10 years.

The invention claimed is:

1. A micro coaxial cable comprising:

an inner conductor;

an insulating layer configured to surround the inner conductor; and a non-annealed helical winding conductor configured to surround the insulating layer and, wherein the non-annealed helical winding conductor has an elongation of 1.5 to 4% and a pitch of 3.0 to 5.0 mm.

2. The micro coaxial cable according to claim 1, further comprising:

a protective coating layer configured to surround the helical winding conductor.

3. The micro coaxial cable according to claim 1, wherein the helical winding conductor contains tin of 0.3 to 0.6%.

4. The micro coaxial cable according to claim 2, wherein the helical winding conductor contains tin of 0.3 to 0.6%.

5. The micro coaxial cable according to claim 1, wherein the helical winding conductor contains silver of 0.6 to 2.0%.

6. The micro coaxial cable according to claim 2, wherein the helical winding conductor contains silver of 0.6 to 2.0%.

7. The micro coaxial cable according to claim 1, wherein the helical winding conductor includes a plurality of metal lines wound in the form of a helical twist.

8. The micro coaxial cable according to claim 2, wherein the helical winding conductor includes a plurality of metal lines wound in the form of a helical twist.

9. The micro coaxial cable according to claim 1, wherein the inner conductor includes a plurality of twisted metal lines.

10. The micro coaxial cable according to claim 2, wherein the inner conductor includes a plurality of twisted metal lines.

11. The micro coaxial cable according to claim 1, further comprising:

an over-foaming barrier layer formed between the insulating layer and the helical winding conductor and configured to prevent over-foaming of the insulating layer, so that foam cells are formed uniformly in the insulating layer.

12. The micro coaxial cable according to claim 2, further comprising:

an over-foaming barrier layer formed between the insulating layer and the helical winding conductor and configured to prevent over-foaming of the insulating layer, so that foam cells are formed uniformly in the insulating layer.

* * * * *